United States Patent [19]

Parigi et al.

[11] Patent Number: 5,050,856

[45] Date of Patent: Sep. 24, 1991

[54] MACHINE AND METHOD FOR SLOWING DOWN A SERIES OF IRON SHEETS TRAVELING IN CLOSE SUCCESSION AFTER EACH OTHER ALONG A PRODUCTION LINE

[75] Inventors: Marcello Parigi, Milan; Pompeo Rovelli, Como, both of Italy

[73] Assignee: FIMI S.p.A. Fabbrica Impianti Macchine Industriali, Como, Italy

[21] Appl. No.: 413,820

[22] Filed: Sep. 28, 1989

[30] Foreign Application Priority Data

Oct. 11, 1988 [IT] Italy ..... 22266 A/88

[51] Int. Cl.[5] ..... B65H 29/68

[52] U.S. Cl. ..... 271/182; 271/202

[58] Field of Search ..... 271/182, 202, 176, 265, 271/270, 273; 414/794.8, 792.7; 198/577, 579, 623, 784

[56] References Cited

U.S. PATENT DOCUMENTS 2,485,952 10/1949 Apgar et al. ..... 414/794.8 X

FOREIGN PATENT DOCUMENTS 244864 10/1987 Japan ..... 271/176
812485 4/1959 United Kingdom ..... 271/182
1499104 1/1978 United Kingdom ..... 271/182

*Primary Examiner*—David H. Bollinger
*Attorney, Agent, or Firm*—Diller, Ramik & Wight

[57] ABSTRACT

A machine slows down a series of sheets which are conveyed in close spaced succession to each other by conveying the sheets between a pair of rolls defining a gap of predetermined size therebetween. The rolls are disposed with their axes transverse to the direction of travel of the sheets and are rotated at a peripheral speed less than the speed at which the sheets are conveyed into the gap between the rolls. A mechanism is provided for moving the rolls to close the gap and bring the rolls into contact with the sheet whereupon the speed of the sheet is reduced.

39 Claims, 2 Drawing Sheets

MACHINE AND METHOD FOR SLOWING DOWN A SERIES OF IRON SHEETS TRAVELING IN CLOSE SUCCESSION AFTER EACH OTHER ALONG A PRODUCTION LINE

BACKGROUND OF THE INVENTION

The present invention relates to a machine and a method for slowing down a series of iron sheets traveling in close succession after each other along a production line.

The present production lines for iron sheets comprise a reel from which a roll of metal band is unwound, a flattening machine, a shearing machine, a conveyor belt ending in a collecting pit, and the collecting pit possibly housing a stacking device.

The iron sheets which are formed at the shearing machine are transported by means of the conveyor belt into the collecting pit, to which they arrive at the same speed as that of the conveyor belt.

Each iron sheet which comes to the collecting pit is stopped by bumping into a stopping shoulder installed on the pit wall opposite to the direction of travel of the incoming iron sheets. The stop shoulder is advantageously coated with a suitable material, capable of easily absorbing the impact energy without the iron sheet being damaged.

In order to limit the damage caused by this impact, the operating trend has always been to look for soft materials which are also tough, and thus resistant to the shearing effect performed on them by the impact of the iron sheet.

With the adoption of faster and faster production lines, serious difficulties have arisen in finding suitable materials for absorbing the kinetic energy of the impact. In fact, with increasing values of the kinetic energy of impact, it is necessary to have available softer and softer materials, in order not to damage the edges of the metal plate, which are simultaneously tougher and tougher in order to withstand the shearing effect of the iron sheet. This is obviously impossible.

DESCRIPTION OF THE PREFERRED EMBODIMENTS

As a result, the present production lines cannot mandatorily fully exploit their high-speed operating characteristics, otherwise the leading edge of the iron sheets, and/or the front surface of the material used in order to coat the stop shoulder would be damaged.

SUMMARY OF THE INVENTION

The purpose of the present invention is that of providing the solution to the above stated technical problem, enabling the presently available production facilities to fully exploit their potentiality.

Such a purpose is achieved by a machine for slowing down a series of iron sheets traveling in close succession after each other along a line of production of said iron sheets the machine is characterized in that it comprises a machine base, two shoulders and a crosspiece forming a support framework which supports roll means installed transversely to the production line, defining an air gap and acting on an iron sheet traveling through said air gap, so as to remove from said iron sheet at least a portion of its kinetic energy.

The invention is illustrated for merely exemplifying, non-limitative purposes in the figures of the hereto attached drawings, in which:

DESCRIPTION OF THE PREFERRED EMBODIMENTS

Figure 1:
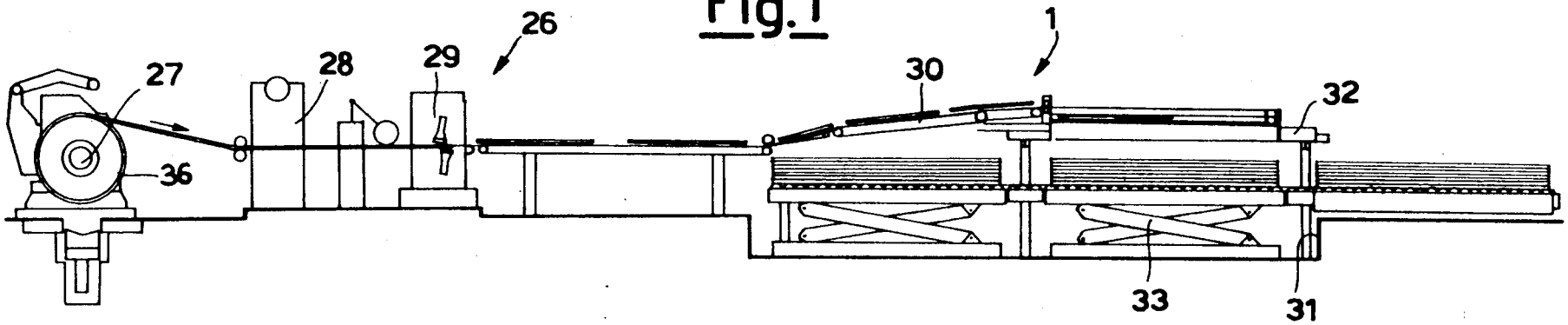
FIG. 1 shows a production line along which a machine according to the present invention is installed.
Figure 4:
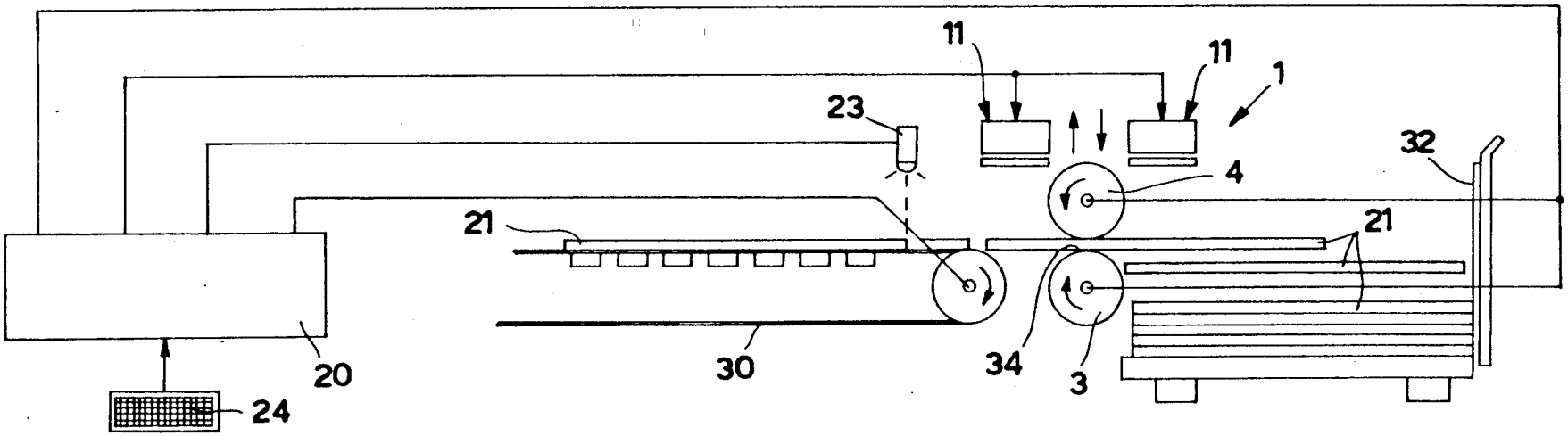
FIG. 4 shows a schematic sectional view of the machine.
Figure 2:
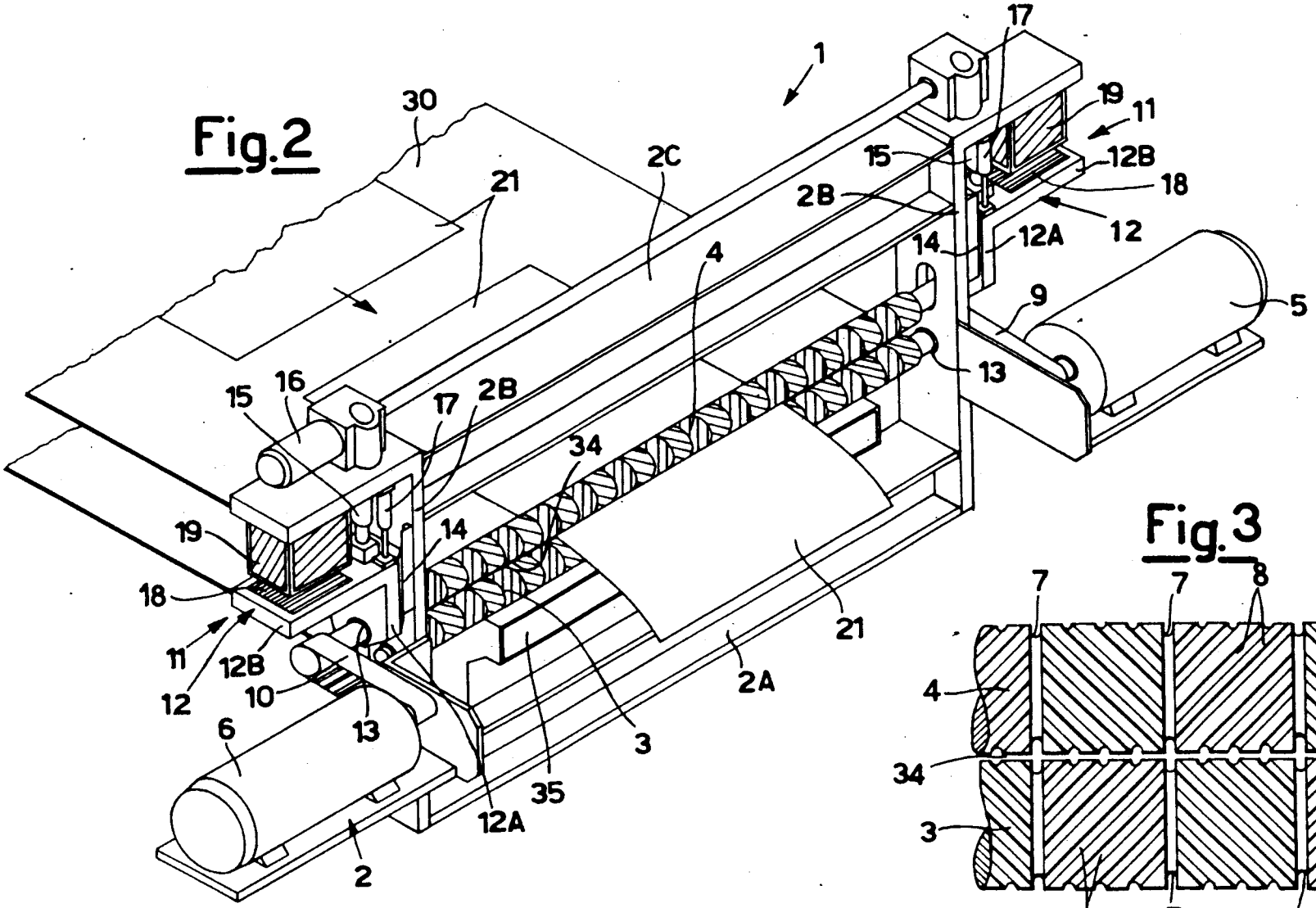
FIG. 2 shows a perspective view of the machine.
Figure 3:
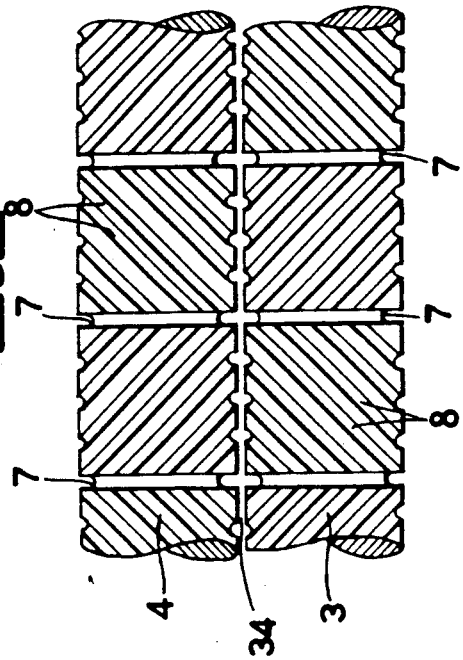
FIG. 3 shows a partial view of the rolls the machine is equipped with, and, in particular, the grooved surface of said rolls.

Referring to the above cited figures, the machine according to the present invention, generally indicated by the reference numeral 1, is transversely positioned along a traditional line 26 for the production of iron sheets conveyed in close sequence. The line 26 comprises a reel 27 which unwinds a roll of metal plate band 36, a flattening machine 28, a shearing machine 29, a conveyor belt 30, a collecting area or pit 31 for collecting the iron sheets, a stop shoulder 32 of said collecting pit 31 and a stacking device 33.

The machine 1 according to the present invention is installed between the conveyor belt 30 and the collecting pit 31, and comprises a support framework 2, roll means 3, 4 defining an air gap 34, a first motor 5 and a second motor 6 acting on said roll means 3, 4 together with means 11 for the adjustment of the air gap 34 defined by the rolls 3 and 4. In the herein illustrated case, the roll means 3, 4 are constituted by a first cylindrical roll 3 and a second cylindrical roll 4 opposite to each other, having dimensions substantially coincident with the width of the conveyor belt 30 and with the width of the iron sheets 21 which are to be slowed down. There is no reason why said roll means 3, 4 should not be constituted by more than two rolls, with some of said rolls 3, 4 being possibly connected with a traveling belt destined to come into direct contact with the iron sheet 21 which is to be slowed down. The support framework comprises a base 2A, shoulders 2B and a crosspiece 2C.

Both the first roll 3 and the second roll 4 are coated with a grooved elastic material (for instance, rubber known on the market under the trade mark "Vulcolan"). The grooving 7, 8 of each roll 3 and 4 comprises, e.g., a set of annular channels 7 parallel to one another, connected by oblique connecting channels 8, with the depth and the width of said connecting channels 8 being smaller than the depth and width of said annular channels 7.

The geometry of the grooving 7, 8 may be of several types, all of which share the common purpose of effecting a correct friction between the surfaces of the rolls 3 and 4 and the surfaces of the iron sheet 21 even should the iron sheet 21 be coated by an oil film due to previous processing step.

Obviously, in case the surfaces of the iron sheet 21 are coated by an oil film, the grooving 7, 8 makes it possible for the oil film to be "broken", with a practically direct contact being established between the surfaces of the rolls 3, 4 and the surfaces of the iron sheets 21 which is the essential condition in order that a correct transfer of kinetic energy from the iron sheet 21 to the rolls 3, 4 may take place, i.e., without relative slippage, which causes a decrease in iron sheet quality. The first roll 3 revolves around its own axis by drive from the first motor 5 and the relevant transmission belt 9, and is fixed to the framework 2, i.e., without its revolution axis being changed in position.

The second roll 4 revolves around its axis by drive from the second motor 6 and the relevant transmission belt 10, and, the position of its revolution axis can be changed according to parallel axes, by the effect of adjusting means 11.

The fact that only the position of the revolution axis of the second roll 4, and not of the first roll 3, or of both of rolls 3 and 4, can be changed due to the effects of the action of the adjusting means 11 is only due to a structural choice, and is not a technical choice imposed by particular requirements the invention should meet.

The adjusting means 11 provided on each machine shoulder 2B comprise, for each shoulder 2B, an "L"-shaped element 12 mounted for sliding movement relative to said shoulder 2B, a pneumatic cylinder 17, screw means 15, an electromagnet 19 and an anchor 18, with all of said elements being interposed between said "L"-shaped element 12 and the framework 2.

Each "L"-shaped element 12 comprises a first flange 12A and a second flange 12B perpendicularly united at one of their ends.

The first flange 12A houses bearings 13 installed at the ends of the second roll 4, and is provided with guides 14 which enable it to slide in a vertical direction relatively to the relevant shoulder 2B when and the pneumatic cylinder 17, the screw means 15, the electromagnet 19 act on the second flange 12B.

Each pneumatic cylinder 17 applies a pressure resulting in a predetermined preload, so as to move the roll 4 towards the roll 3, with the screw means 15 simply acting as an adjustable stop element, i.e., as a stroke-limit element limiting the stroke of the cylinders 17, thus preventing the rolls 3 and 4 from approaching each other by a distance less than the programmed distance, thus controlling the minimum size of the air gap 34.

The load applied to each iron sheet 21 by the rolls 3 and 4 due to the effect of the action of the pneumatic cylinders 17 is established as a function of the characteristics of the same iron sheet 21.

Therefore, the screw means 15 do not hinder the roll 4 from being taken away from roll 3. In order to accomplish such a taking-away movement, it is enough that the preload applied by the cylinders 17 is counteracted by a greater counterforce.

The preload generated by the cylinders 17 is counteracted within a time of a few fractions of a second by an opposite force exceeding said preload, applied by the electromagnets 19 when the need arises for the air gap 34 to exceed in height the thickness of the iron sheet 21.

A motor 16 drives the screw means 15.

The machine 1 is completed by a blowing device, the mouth 35 of which acts on the lower surface of the iron sheet 21 which is disengaging from the rolls 3 and 4 in order to favour the subsequent correct stopping against the stop shoulder 32 and the stacking of the sheet in the pit 31.

The operation of the machine 1 is controlled by an electronic central control unit 20, equipped with a relevant keybord 24, by means of which the processing data is entered. The central control unit 20 detects the speed of an incoming iron sheet 21 laying on the conveyor belt 30 by means of speed detectors installed on the conveyor belt 30, not shown in the drawings.

By means of the photocell 23, the central control unit 20 detects the position of the leading edge of the iron sheet 21 and consequently acts on the motors 5, 6, 16, on the electromagnets 19 and on the pneumatic system of the machine 1, in order to perform and complete the cycle of slowing down of the iron sheet 21 as a function of a pre-established program making due allowance for the physical dimensions of the sheet 21, communicated by an operator to the central control unit through the keyboard 24.

The slowing down cycle through the operation of the machine 1 are as follows.

The incoming iron sheet 21 runs at the same speed as of the conveyor belt 22.

The distance—viz., the air gap 34—between the first roll 3 and the second roll 4 is established by the central control unit 20 as a function of the thickness of the sheet 21, which is one of the process data entered to the central control unit 20 through the keyboard 24. The air gap 34 is thinner than the thickness of the iron sheet 21 so that the rolls 3 and 4 can apply to said iron sheet 21 a high enough pressure in order to prevent any relative slidings.

The motors 5 and 6 are started up, causing the rolls 3 and 4 to revolve at a peripheral speed identical to the linear speed of the iron sheet 21 to be slowed down.

The iron sheet 21 engages the rolls 3 and 4 without slippage occurring between the surfaces of the rolls 34 and of the iron sheet 21.

The revolution speed of the motors 5 and 6 is descreased—with said motors acting as a brake and consequently slowing down the iron sheet 21.

The iron sheet 21 leaves the rolls and, at a decreased speed, bumps into the stop shoulder 32 of the collecting pit 31, getting stacked, without suffering any damage either caused by slippage or due to impact.

The revolution speed of the rolls 3 and 4 is increased again, until the rolls 3, 4 are caused to revolve at the same speed as of the iron sheet following the just slowed down sheet.

The speed V at which the sheet 21 bumps into the stop shoulder is pre-established by assuming as the base of the calculation the formula of the kinetic energy possessed by the iron sheet at the time of the impact:

$$E=\tfrac{1}{2}mV^2$$

wherein:

m=is the mass of the iron sheet, as kg-mass

V=is the speed of the iron sheet, as m/second

E=energy, as N.m

On the basis of experimental tests, as the limit safety parameter the $E_1$ kinetic energy is assumed, which relates to the impact undergone without any damages by a steel sheet of 3 mm of thickness, 1,100 mm of width, 1,000 mm of length 25.75 kg at weight, arriving at the stop shoulder 32 with rectilinear movement at a speed of 75 m/minute, and without the stop shoulder being damaged.

Starting from this reference value of kinetic energy, the operating parameters are computed for the system, for all of the forecast production cases.

$$\text{impact speed } V=\sqrt{2E_1/m}$$

wherein $E_l$ = value of kinetic energy assumed as the limit safe value (parameter), which is a pre-fixed and constant value;

m = variable mass of the iron sheet to be processed, which, on the contrary, is a variable value.

The speed at which the impact against the stop shoulder 32 takes place is hence variable as an inverse function of the mass, and, therefore, of the dimensions of the iron sheet 21 with the value of the kinetic energy involved by the impact of the iron sheet 21 against the stop shoulder 32 being, constant and pre-fixed.

The stop shoulder 32 can be coated therefore with soft and tough materials, commonly available from the market, without either they or the sheets 21 being damaged when the impact takes place.

In case of small-size sheets 21, the production speeds can be such that the distance between the sheets 21 does not allow the machine 1 to perform the slowing down cycle by means of the hereinabove disclosed procedure, without relative slippage occurring between the surfaces of the incoming iron sheet 21 and of the rolls 3 and 4, whose peripheral speed is still lower than the linear speed of the iron sheet 21. Should the contact between the iron sheet 21 and the rolls 3, 4 takes place under such conditions, an impact effect would result which is such as to cause the surfaces of the rolls 3, 4 to be damaged.

The slowing down cycle is modified as follows:

When the iron sheet 21 to be slowed down arrives in the nip of the rolls 3 and 4, the latter have just ended a cycle of slowing down a preceding iron sheet 21.

Therefore, the motors 5 and 6 do not have the necessary time for performing the step of re-accelerating the rolls 3 and 4, so as to cause them to revolve at a peripheral speed equal to the linear speed of the incoming iron sheet 21 which peripheral speed is necessary, as was earlier stated; in order to prevent relative slippage to take place between the rolls 3, 4 and the iron sheet 21.

Therefore, in order to prevent the rolls 3, 4 from beginning to operate on an iron sheet 21 with a peripheral speed not the same as the linear speed of the same iron sheet 21, the electromagnets 19 intervene. The electromagnets 19 are excited and attract the anchor 18, developing a force higher than the pre-load generated by the pneumatic cylinders 17 which under such conditions act as elastic elements.

The second roll 4 is lifted, thus being prevented from interfering with the sheet 21 and pressing it against the underlying first roll 3.

Simultaneously, the motors 5 and 6 accelerate the rolls 3 and 4 until said rolls reach the required peripheral speed. When the required peripheral speed is reached, the electromagnets 19 are de-energized and the cylinders 17 urge the second roll 4 against the iron sheet 21 and therefore against the first roll 3.

The motors 5 and 6 begin their braking action, slowing down the iron sheet 21.

The sheet 21 continues running thus traveling beyond the rolls 3, 4, and enters the collecting pit 31, inside of which it is stacked.

The machine 1, suitably programmed, can be also installed in other points of the production line in order to both slow down, and brake, or even accelerate, the iron sheets 21.

Self-understandingly, the application field of the machine according to the present invention can be expanded as well to sectors operating on sheet elements, or on plate elements, which are not necessarily metal sheets.

We claim:

1. A machine for slowing down a series of sheets being conveyed in close spaced succession to each other comprising means for conveying a series of sheets in close spaced succession to each other at a first speed along a path of travel, first and second rolls each having an axis of rotation disposed transversely to the path of travel, said first and second rolls defining a gap of a predetermined size therebetween through which successive sheets pass during conveyance along said path of travel, first and second means for respectively driving said first and second rolls selectively at a peripheral speed less than the first speed of the series of sheets during conveyance along said path of travel, means for movably supporting one of said first and second rolls and means for selectively varying the predetermined gap size by effecting movement of said one roll relative to the other of said first and second rolls and engaging a sheet therebetween whereby the lesser peripheral speed of said first and second rolls reduces said first speed.

2. The machine as defined in claim 1 wherein said gap size varying means are disposed at both axial opposite end portions of said one roll.

3. The machine as defined in claim 1 wherein said gap size varying means includes means for limiting the varying of the predetermined gap size to a minimum reduced gap size.

4. The machine as defined in claim 3 wherein said minimum reduced gap size limiting means includes screw means.

5. The machine as defined in claim 1 wherein said gap size varying means includes pneumatic means for effecting movement of said one roll.

6. The machine as defined in claim 1 wherein said gap size varying means includes means for preloading said one roll.

7. The machine as defined in claim 6 wherein said preloading means includes pneumatic means.

8. The machine as defined in claim 1 wherein said gap size varying means includes means for reducing said predetermined gap size.

9. The machine as defined in claim 8 wherein said gap size reducing means includes pneumatic means.

10. The machine as defined in claim 1 wherein said gap size varying means includes means for increasing said predetermined gap size.

11. The machine as defined in claim 10 wherein said gap size increasing means includes electromagnetic means.

12. The machine as defined in claim 1 wherein said gap size varying means includes means for reducing said predetermined gap size, and said gap size varying means further includes means for limiting the reduced gap size to a minimum reduced gap size.

13. The machine as defined in claim 12 wherein said gap size reducing means includes pneumatic means, and said minimum reduced gap size limiting means includes screw means.

14. The machine as defined in claim 1 wherein said gap size varying means includes means for reducing said predetermined gap size, and said gap size varying means further includes means for increasing said predetermined gap size.

15. The machine as defined in claim 14 wherein said gap size reducing means and said gap size increasing means apply oppositely directed forces to said one roll.

16. The machine as defined in claim 14 wherein said gap size reducing means includes pneumatic means, and said gap size increasing means includes electromagnetic means.

17. The machine as defined in claim 1 wherein said gap size varying means includes means for limiting the varying of the predetermined gap size to a minimum reduced gap size, and said gap size varying means further includes means for increasing said predetermined gap size.

18. The machine as defined in claim 17 wherein said minimum reduced gap size limiting means includes screw means, and said gap size increasing means includes electromagnetic means.

19. The machine as defined in claim 1 wherein said gap size varying means includes (a) means for reducing said predetermined gap size, (b) means for limiting the reduced gap size to a minimum gap size, and (c) means for increasing said predetermined gap size.

20. The machine as defined in claim 19 wherein said gap size reducing means includes pneumatic means, said minimum reduced gap size limiting means includes screw means, and said gap size increasing means includes electromagnetic means.

21. The machine as defined in claim 1 including means downstream of said varying means for collecting the sheets.

22. The machine as defined in claim 1 wherein said rolls include a grooved elastic outer peripheral surface.

23. A machine for slowing down a series of sheets being conveyed in close spaced succession to each other comprising means for conveying a series of sheets in close spaced succession to each other at a first speed along a path of travel, first and second rolls each having an axis of rotation disposed transversely to the path of travel, said first and second rolls defining a gap of a predetermined size therebetween through which successive sheets pass during conveyance along said path of travel, means for rotating said rolls at selected peripheral speeds, means for movably supporting one of said first and second rolls, control means for rotating said rolls at a first peripheral speed substantially equal to the first speed of a first sheet prior to the first sheet being gripped by said first and second rolls, means for gripping said first sheet by selectively reducing the predetermined gap size through movement of said one roll relative to the other of said first and second rolls when said first sheet first speed and first and second roll speeds are substantially equal, and said control means being constructed and arranged for controlling the operation of said rolls rotating means by rotating said rolls at a peripheral speed less than the first speed when said first sheet is gripped between said first and second rolls and the first sheet first speed is thereby reduced.

24. The machine as defined in claim 23 wherein said gripping means are disposed at both axial opposite end portions of said at least one roll.

25. The machine as defined in claim 23 wherein said gripping means includes means for limiting the reduction of the predetermined gap size to a minimum reduced gap size.

26. The machine as defined in claim 23 wherein said gripping means includes means for preloading at least one of said first and second rolls.

27. The machine as defined in claim 23 wherein said control means is effective for controlling the operation of said rolls rotating means by increasing the rotation of said rolls from said lesser peripheral speed to substantially the first-mentioned peripheral speed after the first sheet has passed beyond said gap.

28. The machine as defined in claim 27 including means for selectively increasing the gap size from its reduced size to its predetermined size after the first sheet first speed has been reduced.

29. The machine as defined in claim 23 including means for selectively increasing the gap size from its reduced size to its predetermined size after the first sheet first speed has been reduced.

30. The machine as defined in claim 23 wherein said control means is effective for controlling the operation of said rolls rotating means by increasing the rotation of said rolls from said lesser peripheral speed to substantially the first-mentioned peripheral speed after the first sheet has passed beyond said gap, and means for selectively increasing the gap size from its reduced size to its predetermined size after the first sheet first speed has been reduced.

31. A machine for slowing down a series of sheets being conveyed in close spaced succession to each other comprising means for conveying a series of sheets in close spaced succession to each other at a first speed along a path of travel, first and second rolls each having an axis of rotation disposed transversely to the path of travel, said first and second rolls defining a gap of a predetermined size therebetween through which successive sheets pass during conveyance along said path of travel, means for rotating said rolls at selected peripheral speeds, means for movably supporting one of said first and second rolls control means for rotating said rolls at a first peripheral speed substantially equal to the first speed of a first sheet prior to the first sheet being gripped by said first and second rolls upon a reduction in the predetermined gap size, means for gripping said first sheet by selectively reducing the predetermined gap size through movement of said one roll relative to the other of said first and second rolls when said first sheet first speed and first and second roll speeds are substantially equal, said control means being constructed and arranged for controlling the operation of said rolls rotating means by rotating said rolls at a peripheral speed less than the first speed when said first sheet is gripped between said first and second rolls and the first sheet first speed is thereby reduced, means for selectively increasing the gap size from its reduced size to its predetermined size after the first sheet first speed has been reduced, said control means being constructed and arranged for controlling the operation of said rolls rotating means by increasing the lesser peripheral speed of the first and second rolls during the last-mentioned gap size increasing and while a second succeeding sheet enters the gap, and said gripping means being constructed and arranged to reduce said predetermined gap size to grip said second sheet only after the last-mentioned lesser peripheral speed of the first and second rolls has reached said first speed.

32. The machine as defined in claim 31 wherein said gripping means are disposed at both axial opposite end portions of said at least one roll.

33. The machine as defined in claim 31 wherein said gripping means includes means for limiting the reduction of the predetermined gap size to a minimum reduced gap size.

34. The machine as defined in claim 31 wherein said gripping means includes means for preloading at least one of said first and second rolls.

35. The machine as defined in claim 31 wherein said control means is effective for controlling the operation of said rolls rotating means by increasing the rotation of said rolls from said lesser peripheral speed to substantially the first-mentioned peripheral speed after the first sheet has passed beyond said gap.

36. The machine as defined in claim 31 including means for selectively increasing the gap size from its reduced size to its predetermined size after the first sheet first speed has been reduced.

37. The machine as defined in claim 31 wherein said control means is effective for controlling the operation of said rolls rotating means by increasing the rotation of said rolls from said lesser peripheral speed to substantially the first-mentioned peripheral speed after the first sheet has passed beyond said gap, and means for selectively increasing the gap size from its reduced size to its predetermined size after the first sheet first speed has been reduced.

38. A method of slowing down a series of sheets being conveyed in close spaced succession to each other comprising the steps of conveying a series of sheets in close spaced succession to each other at a first speed along a path of travel toward first and second rolls each having an axis of rotation disposed transversely to the path of travel, the first and second rolls defining a gap of a predetermined size therebetween through which successive sheets pass during conveyance along the path of travel, rotating the rolls at selected peripheral speeds, controlling the rotation of the rolls at a first peripheral speed substantially equal to the first speed of a first sheet prior to the first sheet being gripped by the first and second rolls, gripping the first sheet by selectively reducing the predetermined gap size through movement of at least one of the first and second rolls relative to the other of the first and second rolls when the first sheet first speed and first and second roll speeds are substantially equal, and rotating the rolls at a peripheral speed less than the first speed when the first sheet is gripped between the first and second rolls and the first sheet first speed is thereby reduced.

39. A method of slowing down a series of sheets being conveyed in close spaced succession to each other comprising the steps of conveying a series of sheets in close spaced succession to each other at a first speed along a path of travel toward first and second rolls each having an axis of rotation disposed transversely to the path of travel, the first and second rolls defining a gap of a predetermined size therebetween through which successive sheets pass during conveyance along the path of travel, rotating the rolls at selected peripheral speeds, controlling the rotation of the rolls at a first peripheral speed substantially equal to the first speed of a first sheet prior to the first sheet being gripped by the first and second rolls, gripping the first sheet by selectively reducing the predetermined gap size through movement of at least one of the first and second rolls relative to the other of the first and second rolls when the first sheet first speed and first and second roll speeds are substantially equal, rotating the rolls at a peripheral speed less than the first speed when the first sheet is gripped between the first and second rolls and the first sheet first speed is thereby reduced, selectively increasing the gap size from its reduced size to its predetermined size after the first sheet first speed has been reduced, increasing the lesser peripheral speed of the first and second rolls during the last-mentioned gap size increasing and while a second succeeding sheet enters the gap, and reducing the predetermined gap size to grip the second sheet only after the last-mentioned lesser peripheral speed of the first and second rolls has reached the first speed.

* * * * *